United States Patent [19]

McDonald et al.

[11] Patent Number: 4,476,001

[45] Date of Patent: Oct. 9, 1984

[54] DEVICE FOR COLLECTING ALKALINE CELL LIQUOR FROM AN ELECTROLYTIC CELL

[75] Inventors: J. Barrett McDonald, St. Albans; Terry V. Fontalbert, Marmet, both of W. Va.

[73] Assignees: Nova Rubber Co., South Charleston, W. Va.; FMC Corporation, Philadelphia, Pa. ; a part interest

[21] Appl. No.: 480,609

[22] Filed: Mar. 30, 1983

[51] Int. Cl.[3] ..... C25B 15/08; C25B 9/00

[52] U.S. Cl. ..... 204/228; 204/263; 204/275; 204/279; 174/8

[58] Field of Search ..... 204/253-258, 204/263-266, 267-270, 275-278, 279, 228; 210/435; 55/159; 209/352; 366/340; 174/8

[56] References Cited

U.S. PATENT DOCUMENTS

| | | | |
|---|---|---|---|
| 1,140,720 | 5/1915 | Simons | 210/435 |
| 2,405,241 | 8/1946 | Smith | 210/435 X |
| 2,673,232 | 3/1954 | Silsby, Jr. | 204/275 X |
| 3,291,889 | 12/1966 | Uline et al. | 174/8 |
| 3,360,035 | 12/1967 | Loo et al. | 174/8 |
| 3,668,104 | 6/1972 | Loftfield et al. | 204/279 |
| 3,847,783 | 12/1974 | Giacopelli | 204/263 X |
| 3,957,617 | 5/1976 | Aber et al. | 204/228 X |
| 4,270,995 | 6/1981 | Goodridge et al. | 204/270 X |
| 4,341,538 | 7/1982 | Vadnay et al. | 55/159 X |

FOREIGN PATENT DOCUMENTS

| | | | |
|---|---|---|---|
| 625764 | 9/1978 | U.S.S.R. | 204/269 |

*Primary Examiner*—Donald R. Valentine
*Attorney, Agent, or Firm*—Christopher Egolf

[57] ABSTRACT

Device for attachment to the overflow line of an electrolytic cell, for collection of alkaline cell liquor and for concurrent interruption of electrical current flow from cell in such liquor. The device consists of a closed container having a liquor inlet in the top portion of the container and outlet in the bottom portion, with the container being divided internally by a horizontal perforated plate, for separating the incoming liquor flow stream into a multiplicity of streamlets or droplets. The device is fabricated from a non-metallic, transparent material that is resistant to the hot alkaline cell liquor, preferably polymethylpentene plastic.

13 Claims, 2 Drawing Figures

DEVICE FOR COLLECTING ALKALINE CELL LIQUOR FROM AN ELECTROLYTIC CELL

BACKGROUND OF THE INVENTION

1. Technical Field

The invention relates to a device for collecting alkaline liquor that overflows from an electrolytic cell and for concurrently interrupting electrical current flow from the cell in such liquor, and, particularly, to such a device intended for use with chlor-alkali cells.

2. Background Art

Chlor-alkali electrolytic cells are typically operated in lines, in which many cells are connected electrically in series. The chlorine and hydrogen gas and weak caustic liquor (aqueous sodium hydroxide) produced by the individual cells are collected and passed into headers, through which the gaseous and aqueous products of a cell line are directed to respective storage areas, further treatment, or the like.

Weak cell liquor produced in the chlor-alkali cell is typically a hot (~90° C.) caustic solution containing about 12–13 wt. % NaOH and 15 wt. % NaCl, and it is normally withdrawn by gravity overflow through a pipe (sometimes called a "perk" pipe) in the side of the cell container. The amount of cell liquor that overflows is dependent on the rate at which brine is fed to the chlor-alkali cell, which is a function of the size and general operating characteristics of the cell.

Because the cell liquor in the overflow pipe is in direct contact with the aqueous solution in the catholyte compartment of the cell, it is desirable to break the continuity of the overflow liquor stream to prevent a flow of electrical current from leaving the cell.

Current interruption is generally accomplished in existing chlor-alkali cell operations by allowing the overflowing cell liquor to pass out of the overflow pipe, open ended or with a stream disperser attachment, and fall or drip into an open collection funnel; see J. S. Sconce, *Chlorine,* Krieger Publishing Co., Huntington, N.Y., 1972, Chapter 5, pp 82, 95, 99.

This procedure has serious drawbacks: exposure of the overflow liquor to the open atmosphere allows corrosive fumes from the caustic liquor to accumulate, resulting in eye and lung irritation to workers in the cell room. The open collection funnel arrangement continues to be used because it allows visual verification by the cell room operator that cell operation, i.e., weak caustic overflow, is normal.

The present invention is a simple device that collects the overflow stream of alkaline cell liquor while simultaneously interrupting current flow, all without exposure of the caustic liquor fumes to the cell room atmosphere.

SUMMARY OF THE INVENTION

In accordance with the present invention, there is provided a cell liquor collection device for attachment to an alkaline liquor overflow line of an electrolytic cell. The device includes a closed container, having a cross sectional area substantially larger than that of the cell liquor overflow line, and a perforated plate, substantially horizontally disposed within the container and extending across the horizontal cross section of the container so as to separate the container into an upper section and a lower section. The perforations in the plate are of sufficient size and number to provide for the expeditious passage of an incoming cell liquor flowstream through the perforated plate as a multiplicity of streamlets or droplets or both, thereby promoting an interruption of current flow from the cell in the overflow liquor stream. There is also a vertically disposed inlet located in the upper section of the closed container and attached to the cell liquor overflow line from an electrolytic cell, through which the overflow cell liquor is introduced into the collection device, and a vertically disposed outlet located in the lower section of the closed container, through which the cell liquor passes out of the collection device by gravity flow. The container, and preferably the entire device, is fabricated from a non-metallic, transparent material that is resistant to hot alkaline cell liquor, polymethylpentene plastic being preferred.

In a preferred embodiment, the closed container is divided into separate upper and lower sections, which are clamped together, sandwiching the perforated plate between the two sections. This allows for access to the perforated plate for cleaning, maintenance or replacement.

The perforated plate is desirably from 10 to 40 cm in its largest dimension, and may contain from 3 to 250 apertures, each having a diameter of from 1 to 10 mm.

DETAILED DESCRIPTION

Figure 1:
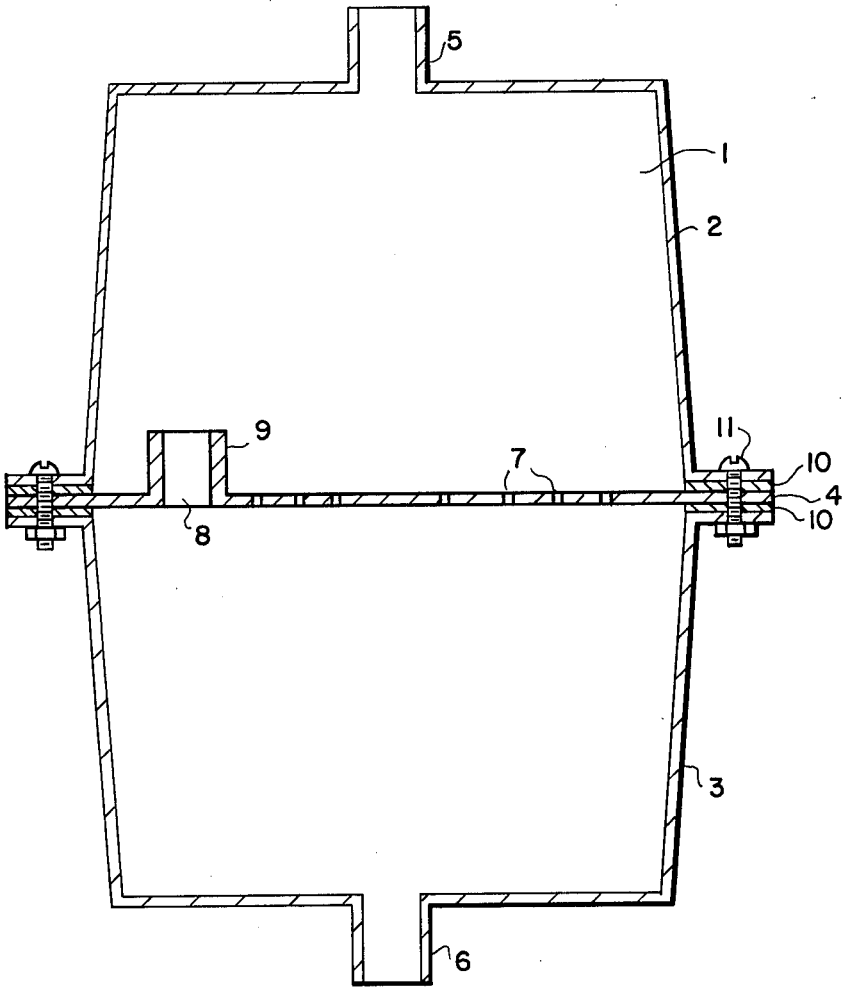
FIG. 1 illustrates a preferred embodiment of the invention, a vertical cross section of the cell liquor collection device being shown.

The closed container, which is the most visible element of the collection device, may be any of several shapes. Its overall shape is preferably determined by the space available for installation of the device on the overflow line of an existing chloralkali cell. Preferred shapes for the closed container include generally cylindrical, spherical, or that of two cones, or funnels, placed base-to-base. The closed container of the cell liquor collection device is preferably of a size having a volume between about 1 liter to 15 liters, more preferably 3 to 10 liters.

The closed container houses the perforated plate, which functions as a flow disperser and promotes interruption of electrical current flow. The closed container of the device also prevents the escape, or loss, of overflowing cell liquor into the cell room atmosphere, by evaporation, atomization, or otherwise. Two significant advantages result from this: first, exposure of cell room operators to the corrosive, irritating cell liquor fumes is avoided, and secondly, heat losses from evaporation of the hot, overflowing cell liquor are minimized.

The perforated plate in the collection device is contained in the closed container, effectively dividing the container into an upper section and lower section. These two sections, or portions, of the closed container need not be equal in volume.

The collection device is desirably constructed so as to permit ready access to the perforated plate located within the closed container, for cleaning, maintenance, replacement, or the like. To this end, in a preferred embodiment of the collection device, the closed container has separable upper and lower sections which are releasably fastened or otherwise mated together. Any of several conventional means may be used to hold the two sections and, optionally, the perforated plate together as an assembly. The two sections, if flanged, can be fastened together with clamps or with nut/bolt or other fasteners passing through the flanges. Alternatively, the two sections may be fastened together with a lip/groove or male/female thread arrangement.

The perforated plate in this preferred embodiment is located approximately between the two releasably-mated sections. It is preferably sandwiched, by clamping means, between the two container sections, with gaskets for preventing leakage. The perforated plate may alternatively be installed or held in one of the sections by press-fit, a lip-groove arrangement or some other means.

The perforated plate is desirably located at the point in the closed container that has the largest cross-sectional area. This ensures that the perforated plate will be relatively large in size, being substantially larger in area than the overflow pipe conveying cell liquor to the collection device inlet.

The perforated plate is preferably from 10 to 40 cm in its largest dimension. Shape of the perforated plate is generally dictated by the particular container configuration used and is not critical; round or oval plate shapes are preferred.

The size and number of perforations must be such as to ensure that the incoming flowstream of weak caustic cell liquor is dispersed upon passage through the plate perforations into a plurality of streamlets and/or droplets. By dispersing or dividing the incoming cell liquor flowstream into a multiplicity of streamlets or droplets or both, the perforated plate serves to promote an interruption of electrical current flow from the cell that would otherwise be lost via the overflow liquor stream.

The perforations, or apertures, must also be of sufficient size and/or number so as to provide for the expeditious flow of liquor through the perforated plate. Liquor flow should not be unduly restricted, which can cause cell liquor to accumulate in the upper portion of the closed chamber and prevent the continued overflow of cell liquor from the cell catholyte chamber.

The location, arrangement and/or pattern of holes in the perforated plate is not critical. Holes near the periphery of the perforated plate are desirably avoided to minimize the chance of continuous liquor flow along the closed chamber wall surface. For this reason, it is preferred that none of the holes be closer than 2 cm to the periphery of the plate, where it meets the container wall.

The perforations are preferably from 1 to 10 mm in diameter, most preferably from 2 to 6 mm in diameter. Round apertures are preferred, for ease in fabrication, but other aperture or hole shapes may also be used. The number of such perforations preferably ranges from 3 to 250, most preferably from 75 to 150.

The combination of aperture size and number is preferably such as to yield a total open area in the perforated plate that is approximately 1.5–3 times larger than the cross-sectional area of the cell liquor overflow line.

In addition to the perforations, the perforated plate may optionally contain an overflow hole designed to accommodate sudden surges in cell liquor flow. Typically, the overflow hole is a large (~1–2 cm) opening in the plate having a cylindrical neck extending upwards (~1–3 cm) from the plate surface.

The inlet and outlet, respectively located in upper and lower sections of the closed container, should be of sufficient size to accommodate the anticipated maximum cell liquor flow rate, without constricting the incoming or exiting flow. The inlet and outlet of the collection device are preferably of a size (diameter/cross-section and length) that facilitates installation of the device in an existing chlor-alkali cell.

The inlet is connected to the overflow line from the cell. The outlet is ordinarily connected to a collection pipe that carries the weak caustic cell liquor from several chloralkali cells in a line.

The inlet should be located in the upper portion, or section, of the closed container, preferably of the topmost point, when the collection device is in its installed attitude. The inlet of the collection device is attached to the overflow pipe from a chlor-alkali weak cell liquor (catholyte) compartment, desirably at the same point at which the flow disperser head and open cup or funnel would otherwise be located on conventional chlor-alkali cells. The inlet of the device may be attached, either directly or indirectly, to the overflow pipe via hose clamps or other conventional fastening devices or techniques.

If it is desired to take periodic flow measurements of the weak caustic cell liquor overflow, using the "bucket and stopwatch" method, a "T" valve or hose connection can be installed in the overflow line to permit the flow stream to be temporarily diverted and collected. Other flowstream collection schemes can also be devised, according to the particular cell liquor overflow set-up and flow measurement requirements.

The collection device of this invention may optionally have flow stream dispersers located within the upper container section near the inlet, so as to create a multiplicity of droplets or flow streams which then impinge or otherwise contact the perforated plate. Such dispersers or flow diverters in the collection device, near or at the inlet, are not required but may be incorporated into the collection device inlet or upper container section if desired.

The location of the outlet in the collection device is desirably at the bottommost point of the lower container section, in the collection device's installed attitude, so that cell liquor does not accumulate in the lower container. The cell liquor, after passing through the perforated plate in the closed container, exits via the outlet by gravity flow.

The outlet is normally attached directly or indirectly, via a pipe or conduit, to a collection pipe or header, which conveys the weak caustic cell liquor overflowing from a line of cells to further treatment, to a storage facility, or the like.

The container, and preferably the other elements of the collection device, are constructed of a relatively-transparent, non-metallic material that is substantially resistant, or inert, to hot alkaline cell liquor, particularly weak caustic cell liquor at a temperature of 80–95° C. The collection device is desirably constructed from a transparent plastic so as to allow for easy visual inspection of the overflow liquor stream and of debris, if any, on the perforated plate. It should be evident that the material of construction of the perforated plate need only be a material that is substantially inert to the alkaline cell liquor; it need not be transparent or necessarily made from the same material as the rest of the collection device.

A preferred material of construction for the collection device is polymethylpentene plastic, preferably poly-4-methylpentene-1, which is a relatively transparent plastic that is not adversely affected by prolonged exposure to hot alkaline cell liquor. Polymethylpentene may be injection molded, which allows for ready fabrication of the collection device from this material.

The collection device of this invention is primarily intended for use on diaphragm-type chlor-alkali cells but may also be used on chlor-alkali mercury cells or on the liquor overflow lines of other types of electrolytic cells.

EXAMPLE

The collection device of this invention and its operation are best described by reference to the accompanying drawings, FIGS. 1 and 2.

FIG. 1 illustrates a vertical cross-sectional view of a collection device, in an installed attitude, which consists of a closed container 1, having an upper container section 2 and lower container section 3. A perforated plate 4 is positioned between the upper and lower sections 2, 3 of the closed container 1. The upper container section 2 has an inlet 5, and the lower container section 3 has an outlet 6.

The upper and lower sections 2, 3 of the closed container 1 are approximately cylindrical in shape, with the round perforated plate 4 being positioned at the midsection of the closed chamber 1 between flanges on sections 2, 3.

Total volume of the closed container 1 is about 7 liters. The cross-section dimension of the device at its midsection is about 24 cm. The collection device measures about 30 cm from the top of inlet 5 to the bottom of outlet 6.

The round perforated plate is about 24 cm in diameter and is approximately 3 mm thick. The perforated plate 4 contains 116 holes 7, each about 3 mm in diameter. The holes 7 are distributed throughout the plate 4, but no holes are located near the periphery of the plate or directly under the inlet 5. This is shown by the illustration in FIG. 2, which is a plan view of the perforated plate 4; reference numerals used in FIG. 2 are the same as those in FIG. 1.

A single overflow hole 8, about 2 cm in diameter, is also located in the perforated plate near the periphery; the overflow hole 8 has a collar 9 extending upwards from the plate approximately 3 cm in length. The collar 9 serves to prevent weak cell liquor within the upper chamber section from passing through the overflow hole 8, unless liquor begins to accumulate in the upper chamber due to abnormal flow surges from the chlor-alkali cell or due to blockage of the plate perforations by asbestos or other debris.

The perforated plate 4 is sandwiched between flanges on the upper container section 2 and lower container section 3, as shown in FIG. 1. Gaskets 10 provide a leak-proof seal between the plate 4 and container sections flanges. The gaskets 10 are made of EPDM (ethylene-propylene diene monomer) polymer elastomer.

Figure 2:
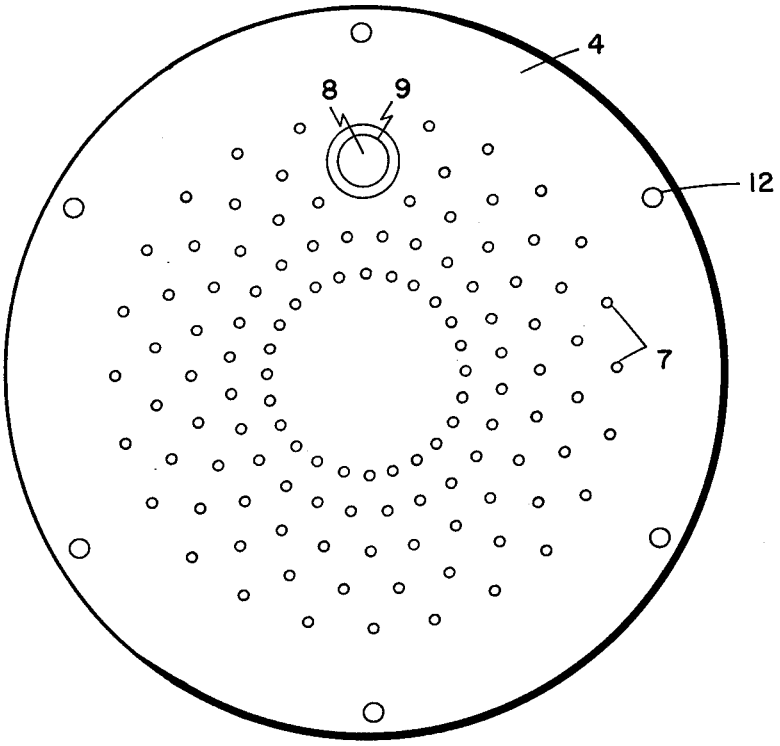
FIG. 2 shows a plan view of the perforated plate.

Access to the perforated plate 4 within the closed container 1 is facilitated by the fact that the assembly of upper and lower sections 2, 3, plate 4, and gaskets 10 is simply held together, with several bolts/nuts 11 that pass through holes in the section flanges (and corresponding holes 12 in plate 4, as shown in FIG. 2, and in gaskets 10). The upper and lower container sections 2, 3 may be readily separated by removing the clamping bolts 11 thereby providing access to the perforated plate 4 for cleaning or replacement.

The inlet 5 located in the upper container section 2 is at the top-most point of the collection device. The inlet 5 is approximately 2 cm in diameter and 2.5 cm in length. The overflow pipe (not shown) from a chlor-alkali cell may be connected to the collection device inlet 5 with a short length of hose that is sleeved over the pipe and inlet and secured in position with hose clamps.

Weak caustic cell liquor, after it passes through the perforated plate 4, is channeled out of the lower container section 3 through the outlet 6. The outlet 6 is approximately 2 cm in diameter and 2.5 cm in length. The outlet 6 is connected (not shown) to a short pipe extension leading to a header for collecting weak caustic cell liquor using a short length of hose held securely in position with hose clamps.

The various elements of the collection device, i.e., upper and lower container sections and integral inlet and outlet, and perforated plate, are fabricated from polymethylpentene, a transparent plastic that is relatively resistant to hot, weak caustic cell liquor from a chlor-alkali cell. The upper and lower container sections are molded from polymethylpentene.

The collection device described above provides numerous benefits and advantages, at relatively low cost, when installed in the overflow line from a chlor-alkali diaphragm cell catholyte compartment:

(a) visual confirmation of cell liquor overflow occurring,
(b) no exposure of corrosive, irritating cell liquor fumes to cell room atmosphere,
(c) minimal heat/energy losses by evaporation of cell liquor from the closed collection device,
(d) reduced electrical current losses in cell liquor overflowing from cell catholyte chamber.

We claim:

1. Cell liquor collection device for attachment to a cell liquor overflow line of an electrolytic cell, which comprises,
   (a) a closed container, having a cross sectional area substantially larger than that of the cell liquor overflow line;
   (b) a perforated plate, substantially horizontally disposed within the container and extending across the horizontal cross section of the container so as to separate the container into an upper section and a lower section, the perforations being of sufficient size and number to provide for the expeditious passage of an incoming cell liquor flowstream through the perforated plate as a multiplicity of streamlets or droplets or both, thereby promoting an interruption of current flow from the cell in the overflowing liquor stream;
   (c) a vertically disposed inlet located in the upper section of the container and attached to the cell liquor overflow line from an electrolytic cell, through which the overflow cells liquor is introduced into the collection device; and
   (d) a vertically disposed outlet located in the lower section of the container, through which the cell liquor passes out of the collection device by gravity flow; said container and its inlet and outlet being fabricated from polymethylpentene plastic.

2. Cell liquor collection device for attachment to a weak caustic liquor overflow line from a chlor-alkali electrolytic cell, which comprises,
   (a) a closed container, having a cross sectional area substantially larger than that of the cell liquor overflow line and consisting of an upper section and a lower section which are releasably mated together;

(b) a vertically disposed inlet located in the upper container section and attached to the cell liquor overflow line from an electrolytic cell, through which the overflow cell liquor is introduced into the collection device;

(c) a vertically disposed outlet located in the lower container section, through which the cell liquor passes out of the collection device by gravity flow; said container and its inlet and outlet being fabricated from polymethylpentene plastic; and (d) a perforated plate, (i) substantially horizontally disposed within the container, extending across the horizontal cross section of the container and separating the upper container section from the lower container section, (ii) having perforations of sufficient size and number to provide for the expeditious passage of the incoming cell liquor stream through the plate as a multiplicity of streamlets or droplets or both, thereby promoting an interruption of current flow from the cell in the overflowing liquor stream, and (iii) being fabricated from a material that is resistant to hot, weak caustic cell liquor.

3. The device of claim 1 or 2 wherein the perforated plate of the collection device is fabricated from polymethylpentene plastic.

4. The device of claim 1 or 2 wherein the perforated plate contains from 3 to 250 holes.

5. The device of claim 1 or 2 wherein the perforated plate contains from 50 to 150 holes.

6. The device of claim 1 or 2 wherein the holes in the perforated plate have a diameter of from 1 to 10 mm.

7. The device of claim 1 or 2 wherein the holes in the perforated plate have a diameter of from 2 to 6 mm.

8. The device of claim 1 or 2 wherein the total area provided by the holes in the perforated plate is about 1.5–3 times larger than the cross-sectional area of the overflow line from the electrolytic cell.

9. The device of claim 1 or 2 wherein the size of the perforated plate is from about 10 to 40 cm in its largest dimension.

10. The device of claim 1 or 2 wherein the holes in the perforated plate are located away from the edge of the plate, at a distance of at least 2 cm from the periphery of the plate, where it meets the container section.

11. The device of claim 1 or 2 wherein the perforated plate contains at least one overflow hole having an upward-extending collar.

12. The device of claim 1 or 2 wherein the perforated plate is sandwiched between flanges located on the upper and lower sections of the closed container.

13. The device of claim 12 wherein the assembly of upper and lower sections and plate sandwiched between them is held in position with clamping means on the section flanges.

* * * * *